US005736927A

United States Patent [19]

Stebbins et al.

[11] Patent Number: 5,736,927

[45] Date of Patent: Apr. 7, 1998

[54] AUDIO LISTEN AND VOICE SECURITY SYSTEM

[75] Inventors: Kevin Stebbins, Maplewood; Paul Severson, Hampton, both of Minn.

[73] Assignee: Interactive Technologies, Inc., North St. Paul, Minn.

[21] Appl. No.: 472,738

[22] Filed: Jun. 7, 1995

Related U.S. Application Data

[63] Continuation of Ser. No. 128,887, Sep. 29, 1993, abandoned.

[51] Int. Cl.[6] ..... G08B 29/00

[52] U.S. Cl. ..... 340/506; 340/531; 340/825.06; 367/197; 381/58

[58] Field of Search ..... 340/506, 531, 340/533, 534, 825.06, 825.15, 825.17, 825.36, 825.37; 367/197, 198, 199; 381/56, 57, 58

[56] References Cited

U.S. PATENT DOCUMENTS

| | | | |
|---|---|---|---|
| 4,918,717 | 4/1990 | Bissonnette et al. | 379/40 |
| 5,109,278 | 4/1992 | Erickson et al. | 348/207 |
| 5,227,776 | 7/1993 | Starefoss | 340/825.36 |
| 5,321,396 | 6/1994 | Lamming et al. | 340/825.36 |

*Primary Examiner*—Andrew Faile
*Assistant Examiner*—Andrew B. Christensen
*Attorney, Agent, or Firm*—D. L. Tschida

[57] ABSTRACT

A security alarm system including multiple, zone distributed audio monitors and alarm sensors which report and verify detected alarms and communicate with a system controller and central station. Ambient audio is continuously and selectively recorded in a storage memory and is replayable to verify alarms detected at the alarm sensors. During pre-alarm conditions, all audio inputs are summed and recorded. During an alarm state, the audio input of the audio monitor physically closest to a reporting alarm sensor is automatically selected and the post-alarm audio activity is recorded only for that sensor. The central station is able to selectively communicate via a phone link with each audio controller and engage in half duplexed voice communication with the alarm site, remotely playback and listen to the locally recorded audio data, or program each audio controller. The monitored audio data is stored in RAM storage in discreet segments corresponding to predetermined periods of pre-alarm and post-alarm data.

11 Claims, 17 Drawing Sheets

AUDIO LISTEN AND VOICE SECURITY SYSTEM

This is a Continuation application Ser. No. 08/128,887, filed Sep. 29, 1993, now abandoned.

BACKGROUND OF THE INVENTION

The present invention relates to security alarm systems including a plurality of distributed alarm sensors which communicate with a system controller and central station and, in particular, to an audio alarm verification system for monitoring pre and post-alarm events in proximity to zoned alarm sensors and including duplex communication capabilities via a phone link to the distributed audio monitors.

Over the years, varieties of alarm systems have been developed for reporting alarm conditions detected at sensors or transducers distributed about a monitored premises. Some report detected alarms via hardwired and radio frequency couplings to a single premises system controller and/or a central station responsive to a number of secured premises. When hardwired, the sensors report over discreet conductors coupled between the sensors and system controller. In some systems one or more telephone lines, in turn, couple system controller communications to the central station. Other systems include RF communication links between the sensor and system controller, the sensor and central controller and between the system controller and central controller.

The presently preferred system permits hardwired and/or RF coupled communications between each of a number of zone distributed sensors and the system controller. Status and alarm communications between the system controller and central station are relegated to conventional telephone lines. Such systems are commercially available from the assignee of the subject invention, Interactive Technologies, Inc., North St. Paul, Minn.

A problem inherent in any alarm system is that of false alarms and especially where alarms are reported to local authorities. False alarms can result in significant operating surcharges and in reduced levels of diligence by responding security personnel. It is therefore desirable that a mechanism be included in a system which permits verification of detected alarm states before an alarm is reported to the authorities. One approach to obtaining such verification is through the use of separate audio monitors operating in concert with separate alarm sensors. U.S. Pat. Nos. 4,591,834 and 4,918,717 disclose two such systems. The U.S. Pat. No. 4,591,834 discloses the use of miniature, low-frequency dynamic microphones. Alarm activities noted at the microphones are verified via a separate network of discriminator sensors which comprise geophones. Signal processing techniques are utilized to distinguish alarm activity. The intrusion and discriminator sensors are arranged in known patterns comprised of multiple sensors of each type.

The U.S. Pat. No. 4,918,717, discloses a system wherein a number of microphones are distributed about a secured premises in relation to other intrusion sensors. Upon detection of an intrusion alarm, the microphones can be manually enabled one-at-a-time from the central station to allow an operator to listen to audio activity in proximity to the sensor alarm. Otherwise, the system does not provide for selective recording of the audio activity, either before or after an alarm event, nor is there an automatic, mapped or zoned correspondence between all of the sensors and the initial selection of the sensor in alarm. Communications between the central station and alarm are limited to a "broadcast" speaker provided at a master station and not to a speaker localized to the alarm site.

U.S. Pat. No. 4,325,058 discloses a system wherein an RF alarm sensor includes a microphone which is separately operable to transmit a local audible alarm. U.S. Pat. No. 4,236,068 discloses a pendant type alarm sensor which includes a loud speaker for transmitting a redundant audio alarm for reception at a telephone handset. U.S. Pat. No. 4,166,273 discloses an intrusion detection system wherein an alarm sensor includes a magnetic tape recorder for accumulating audio signals upon initiation of an alarm. And U.S. Pat. No. 4,894,642 discloses a voice responsive security system wherein a static RAM memory contains prerecorded signals used to generate voice synthesized alarms.

In contrast to the known art, the invention provides a system for automatically monitoring and verifying detected alarms via a number of audio monitors having a mapped physical and/or electrical correspondence to the distributed alarm sensors. A solid state recording capability is also provided for recording before and after audio alarm data at the alarm site. In particular, audio signals in proximity to the sensor in alarm are singled out from all other sensors and separately recorded for later playback. The central station may also selectively communicate with each alarm site via a phone link to each of the audio monitors.

SUMMARY OF THE INVENTION

It is a primary object of the present invention to provide a security alarm system including audio alarm monitoring capabilities with the flexibility of recording predetermined periods of audio activity before and after an alarm.

It is a further object of the invention to provide a system including a plurality of selectable, duplexed audio monitors capable of communicating with a central station.

It is a further object of the invention to provide a system wherein the audio monitors are configured or mapped in a zoned organization corresponding to a number of zone distributed alarm sensors, such that activation of any one of the alarm sensors selects a defined one of the audio monitors having a mapped correspondence to a specific sensor in alarm.

It is a further object of the invention to provide a system wherein all audio signals detected at all of the audio monitors are continuously summed at the audio controller and stored in a segmented storage memory, such as a random access memory (RAM), except during an alarm state. During an alarm state, the audio input closest to the sensor in alarm is automatically selected and thereafter for a predetermined period of time, only the audio from that sensor is recorded. The before and after audio data is real time accessible to a central station.

It is a further object of the invention to provide a half duplexed system wherein, during a predetermined time period related to the entry of an alarm state, the central station may selectively communicate with the premises in alarm via the audio monitor and a number of distributed speakers.

It is a further object of the invention to provide a system including means for isolating central station audio and DTMF commands from the recorded audio.

Various of the foregoing objects, advantages and distinctions of the invention are disclosed in a presently preferred modular system which includes a number of alarm sensors which are distributed about a monitored premises. Ones of the sensors may be hardwired to a site or system controller. Others of the sensors may be coupled via RF communication links to the system controller. The system controller, in turn, typically communicates with the central station via one or more telephone lines. Each of the alarm sensors is addressably identifiable to the system controller by assigned zones and alarm condition priorities.

Also distributed about the premises are a plurality of audio monitors or microphones which communicate with an audio controller. The audio controller can be used as a stand alone assembly or be coupled to the system controller. The audio monitors are separately identified to the central station or system controller in a predetermined correspondence to the alarm sensors. The audio controller communicates with the central station through a telephone link and is programmable by the central station over the phone link.

The audio controller includes microprocessor controlled circuitry which in response to micro-coded instructions continuously monitors and records a summed and encoded digital signal containing audio inputs received from all the audio monitors of the system. Upon detecting an alarm, the audio controller selects and records in a segmented RAM storage memory only the audio input from the alarm monitor closest to the alarm site and sensor in alarm, before returning to normal operation after a predetermined amount of time. Known periods of before and after audio is thereby always available to the central station.

Upon the system controller alerting the central station to an alarm, the audio monitor automatically enables the central station to communicate with the alarm site for a period of time. Half duplexed communications via speakers distributed about the premises or selected monitoring of the audio monitors is conducted over an established phone link. Upon entry of a password, the central station may also listen to the monitored premises via the audio monitors and vary the gain at the microphones.

Circuitry at the audio controller prevents recording of central station communications to the premises. Dual tone multi frequency (DTMF) communications from the central station are also isolated from the recording circuitry. Still other circuitry allows either the audio controller or central station to enable auxiliary annunciators such as sirens or speakers or bells at the system premises.

The audio storage memory is organized into a number of FIFO segments. Predetermined periods of before and after alarm audio data is thereby always available for re-play and review. A timer coupled to the system microprocessor assures proper cyclical operation.

Still other objects, advantages and distinctions of the invention will become more apparent upon reference to the following detailed description with respect to the appended drawings. To the extent improvements and modifications have been considered, they are described as appropriate. The description should therefore not be literally construed in limitation of the invention. Rather, the invention should be interpreted within the spirit and scope of the appended claims.

DESCRIPTION OF THE PREFERRED EMBODIMENT

Figure 1:
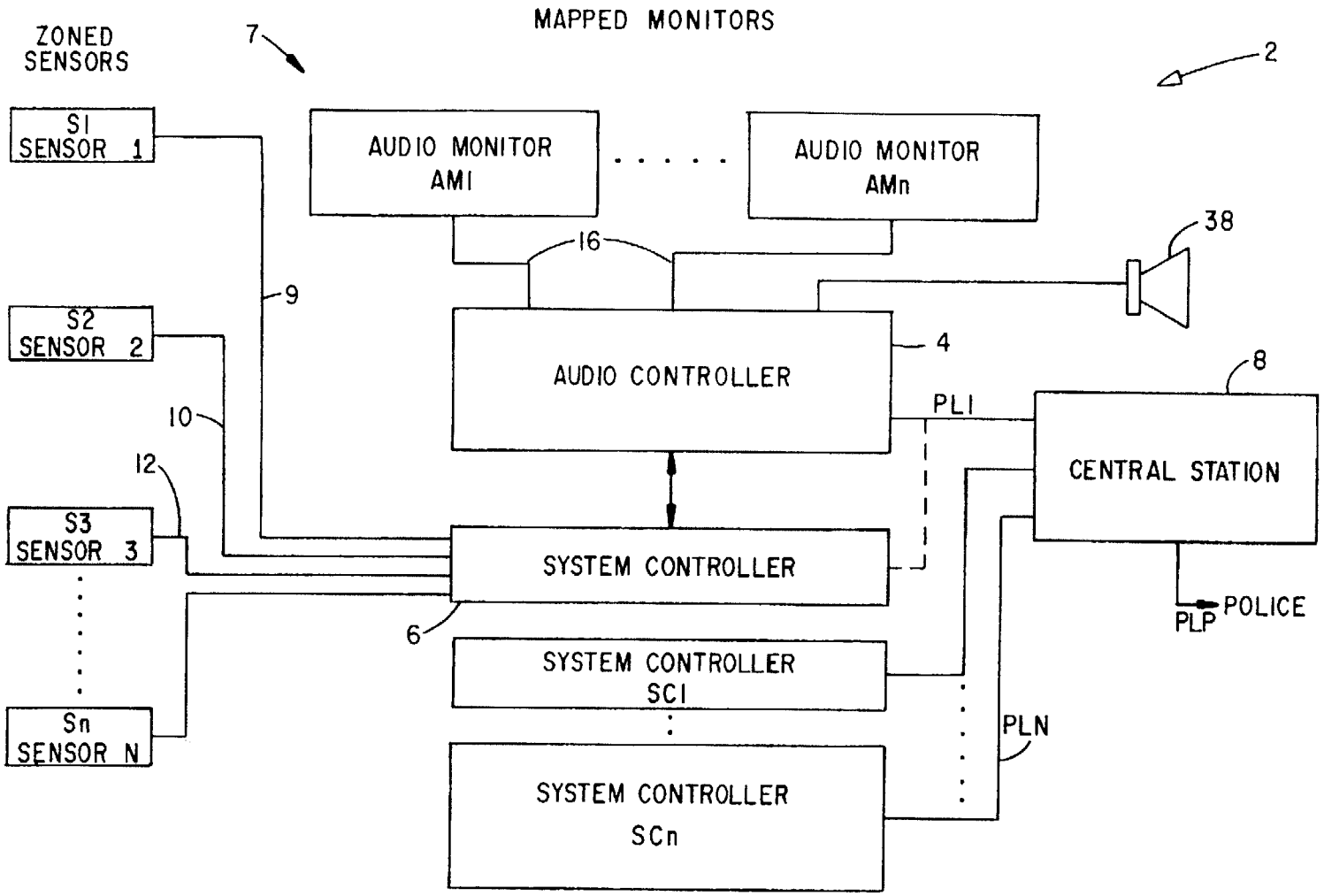
FIG. 1 shows a block diagram of a typical alarm system including the present audio monitoring and alarm verification controller.

With attention to FIG. 1, a block diagram is shown of a typical security network 2, which includes the audio monitoring and verification capabilities of the invention, and which are particularly embodied in an audio controller 4. The network 2 typically includes a number of system controllers SC1 through SCn which communicate with a central station 8 via appropriate numbers of phone lines PL1 to PLn. Each system controller SC1 to SCn monitors a separate and physically distinct subscriber premises.

For illustration purposes, a single audio controller or audio listen module (ALM) 4 is shown coupled to only one system controller 6 of the network 2. Separate audio controllers 4, not shown, may be coupled to any of the other system controllers SC1 to SCn within the network 2. The audio controller 6 can exist as a stand alone assembly or be integrated into the system controller 6. Such an integration may simply comprise the mounting and wiring of the circuitry of the audio controller 4 into the cabinet containing the system controller 6. All audio controllers on the network 2 communicate with the central station 8 via phone lines PL1 to PLN, either directly or through shared phone lines with an associated system controller and as depicted in dashed line.

Figure 2:
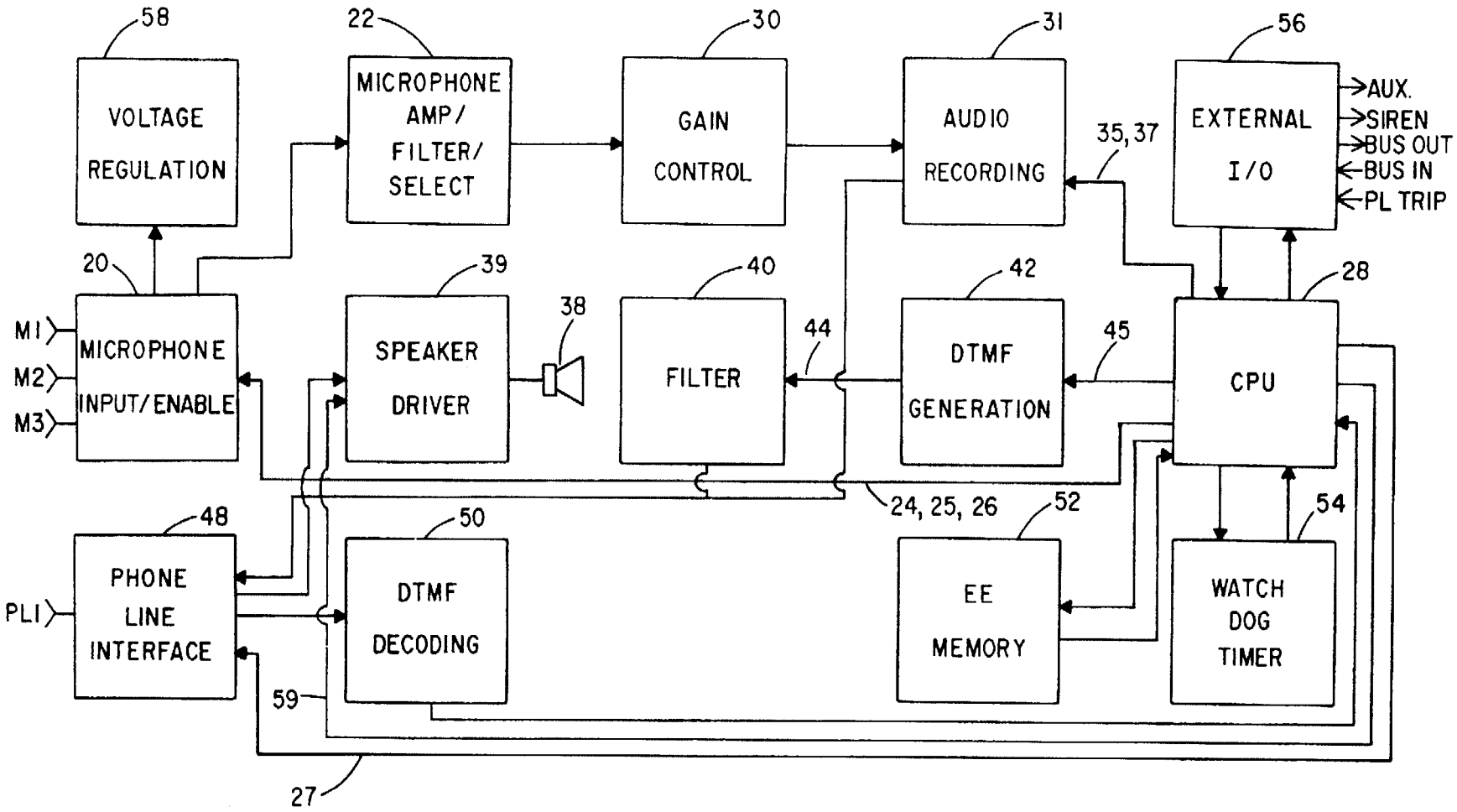
FIG. 2 shows a generalized block diagram of the audio monitoring circuitry.
Figure 3:
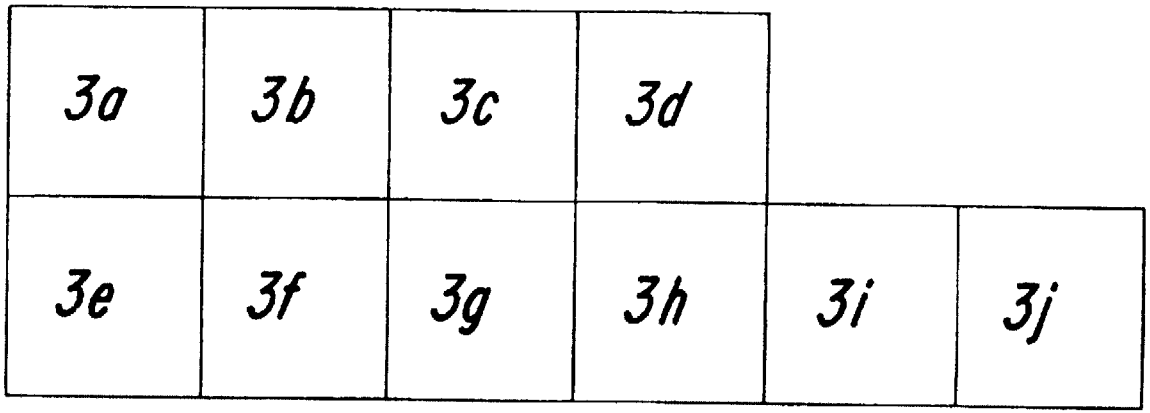
FIG. 3 taken with FIGS. 3*a* through 3*j* show a detailed schematic diagram of the audio controller circuitry.
Figure 3A:
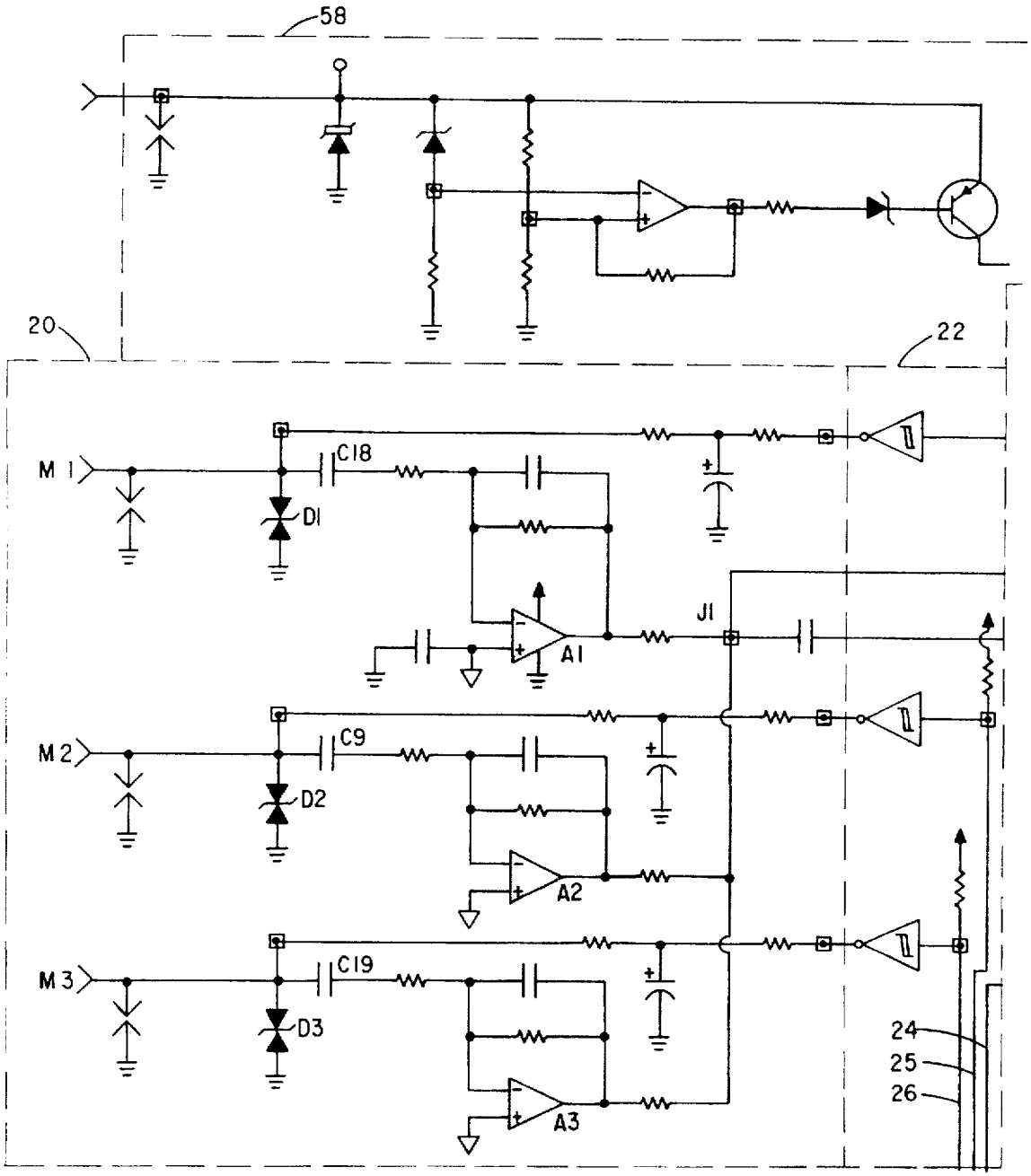
Figure 3B:
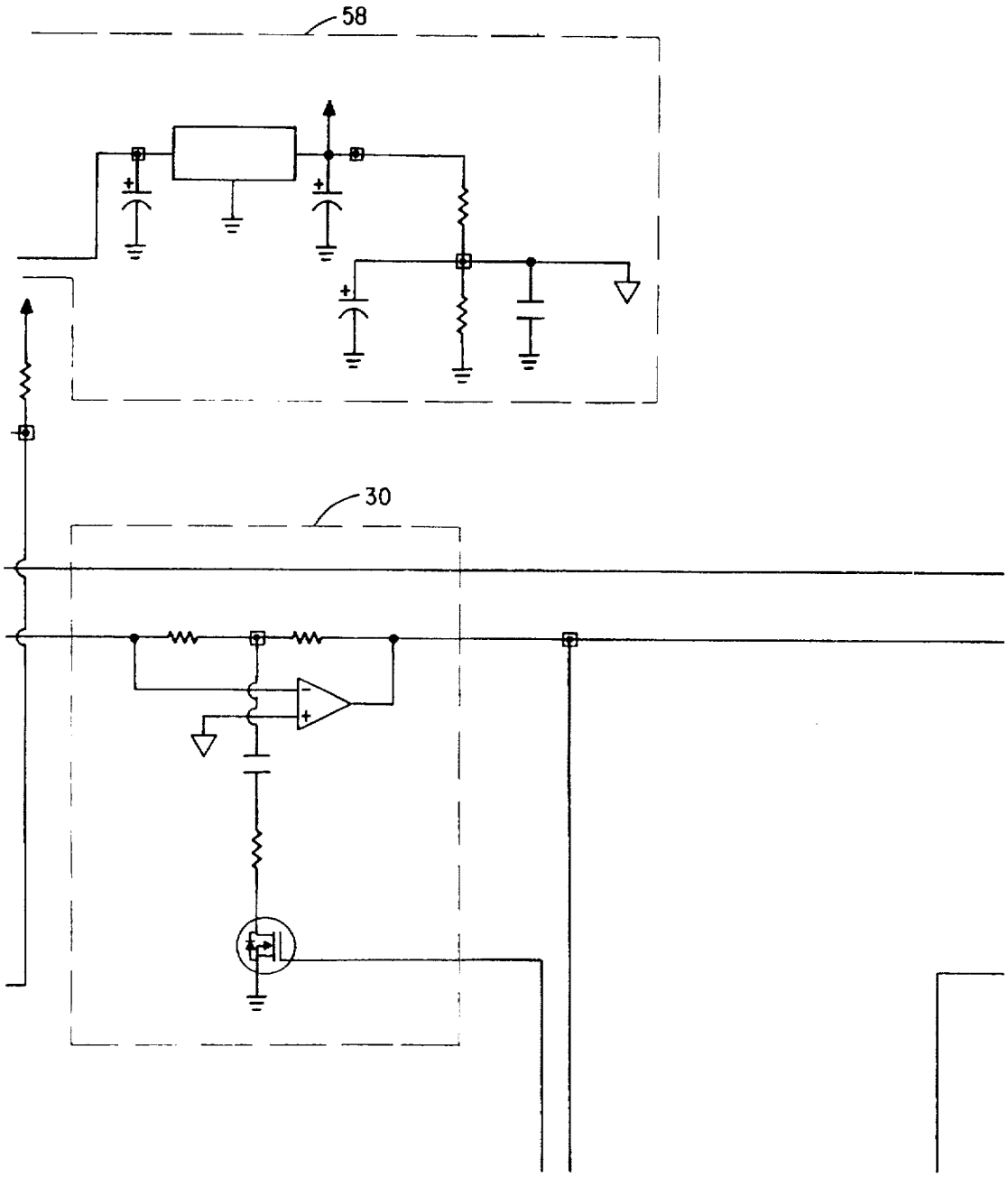
Figure 3C:
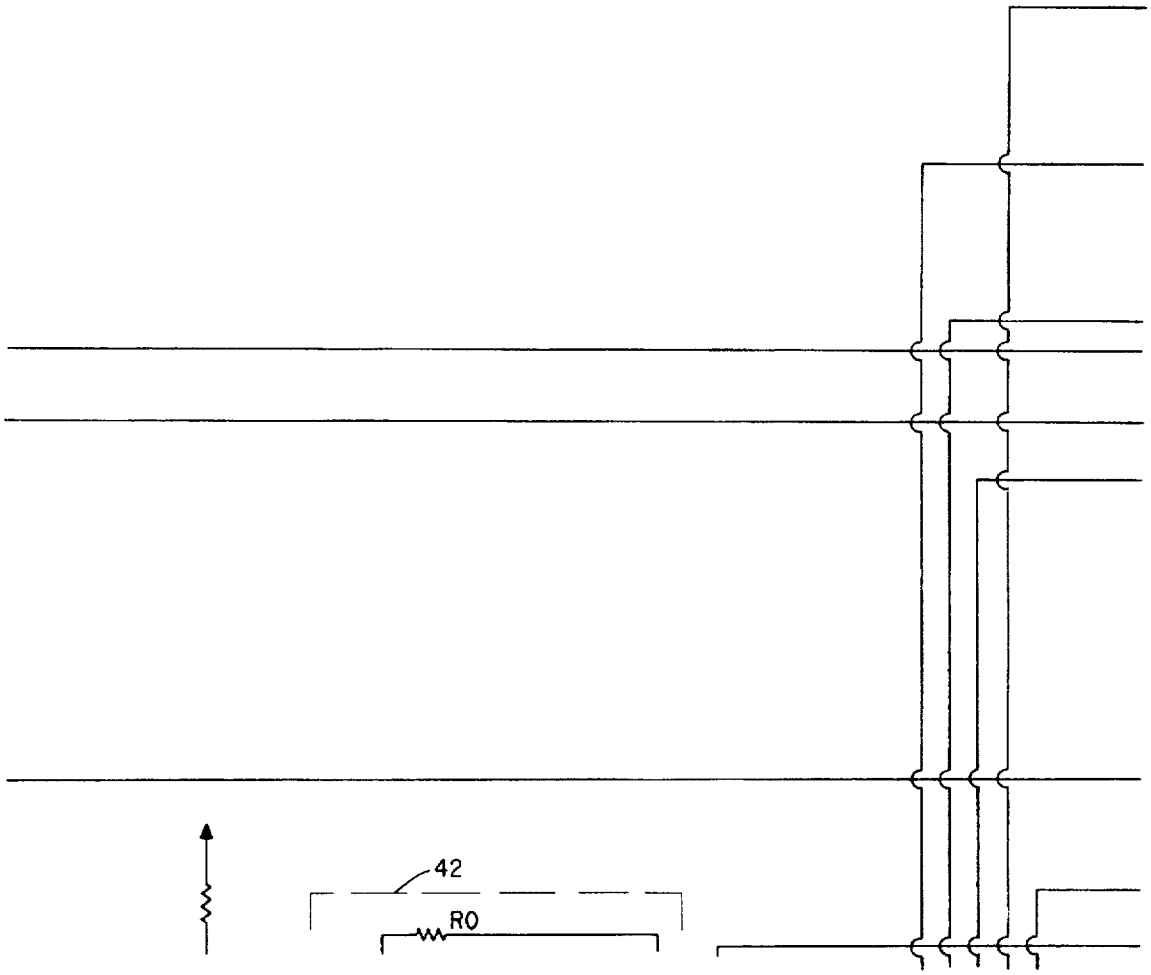
Figure 3D:
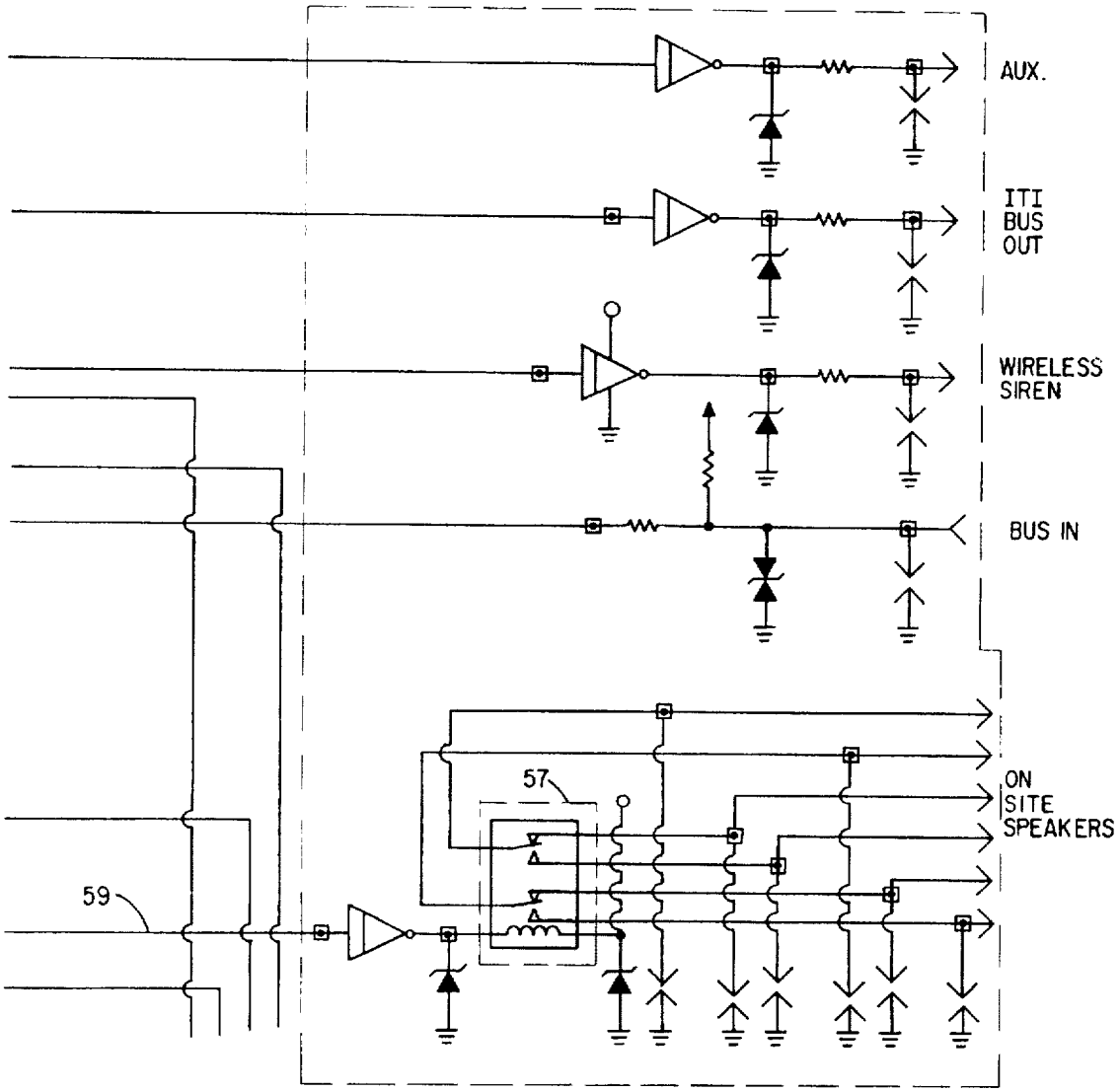
Figure 3E:
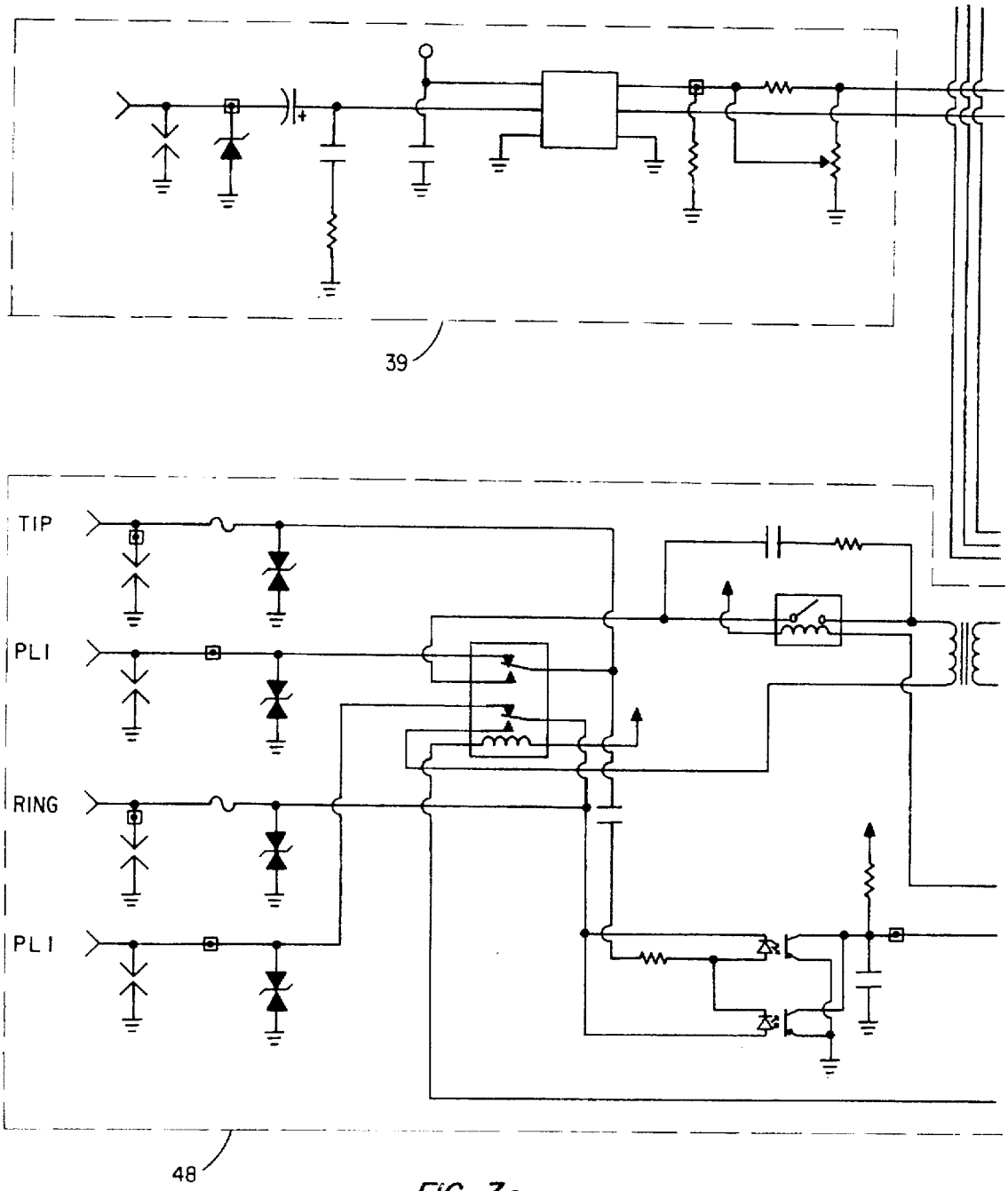
Figure 3F:
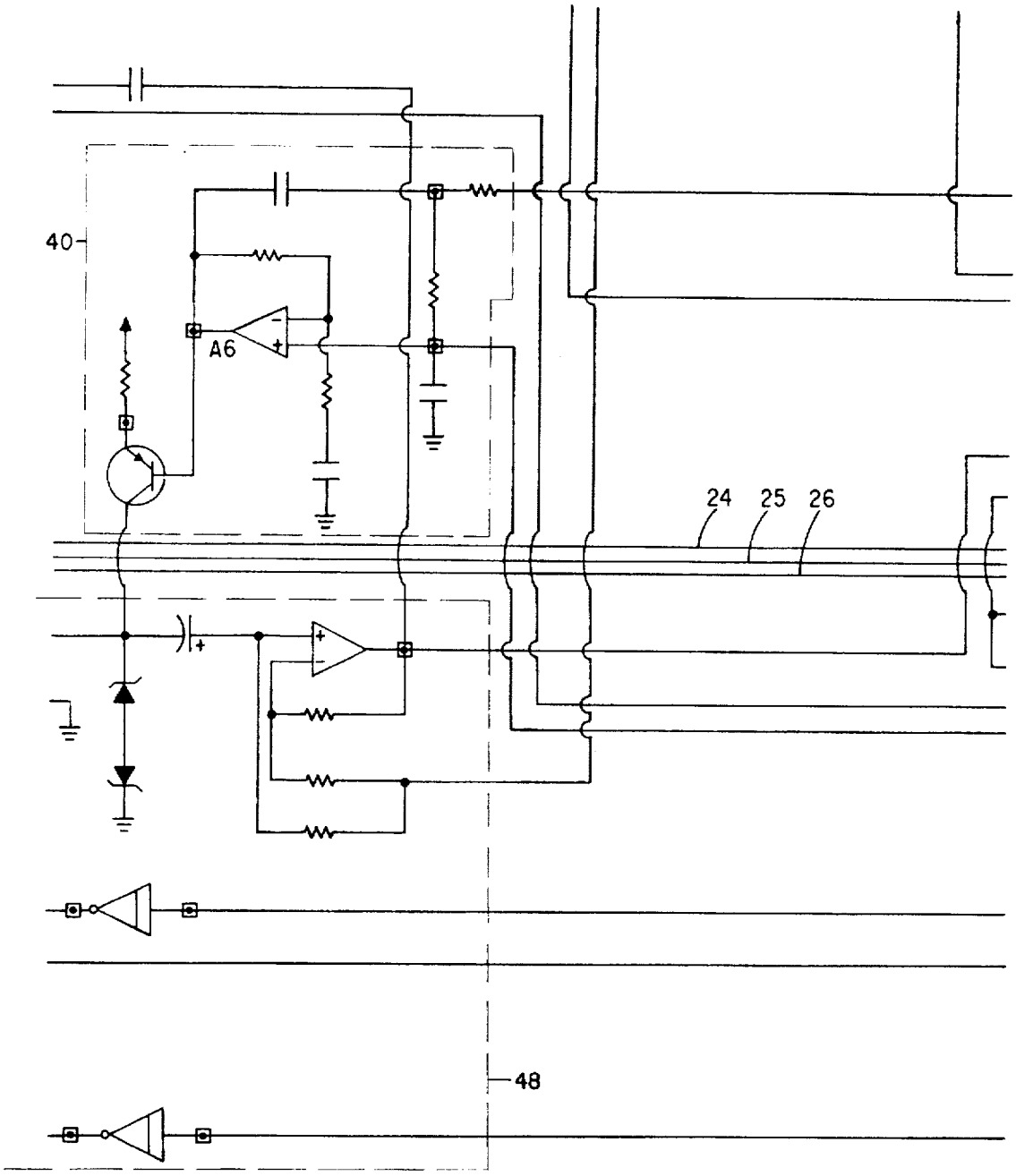

For a subscriber system 7 containing the audio controller 4 and system controller 6, the audio controller 4 is hardwired to the system controller 6 at external (I/O) terminals, reference FIGS. 2 and 3*d*. If the system controller 6 is supplied from Interactive Technologies, Inc., the phone line PL1 is coupled direct to the audio controller 4. Jumper conductors, in turn, couple the controllers 4 and 6 to each other. If the system controller is supplied from another manufacturer, the phone line PL1 may be parallel coupled to each of the audio and system controllers 4 and 6. Separate phone lines may also be coupled to each of the audio and system controllers.

A plurality of alarm sensors, S1 to Sn, communicate with the system controller 6. For the system 7, the sensors S1 and S2 are coupled to the system controller 6 via hardwired conductors 9 and 10. The sensor S3 communicates via a wireless radio frequency (RF) link 12. A variety of different types of sensors S1 to Sn are available for monitoring a variety of physical conditions, such as switch actuations, motion, temperature, smoke etc.

Typically the sensors S1 to Sn are mapped to the system controller 6 in a zoned configuration; that is, in relation to the geographical premises being monitored. Each sensor is addressably identified to the system controller 6 and the alarm and system data communicated from each sensor to the central station 8 is prioritized by the type of sensed condition. More of the details of the system controller 6 and sensors useable therewith are available upon reference to pertinent literature describing the Model SXV alarm system sold by Interactive Technologies, Inc. of North St. Paul, Minn., and the related communication protocol between the sensors, system controller 6 and central station 8.

In the alarm network 2, each of the system controllers 6 and SC1 through SCn communicate with the central station 8 via conventional phone lines PL1 through PLN. Operating personnel at the central station 8 monitor the data from each system controller and take appropriate action, depending upon the data and alarms received. Such action may comprise dispatching central station personnel, notifying appropriate local authorities via a phone line PLP, or notifying personnel at the secured premises. The audio controller 4 facilitates such activities by allowing the central station to audibly check for false alarms, communicate with the premises and retain a recording of audio activity at the monitored premises.

The audio controller 4 particularly responds to analog audio inputs from a number of audio monitors AM1 through AMn, which are distributed about the monitored premises. Presently, each audio monitor consists of an enclosed microphone which is coupled to the audio controller 4 via separate twisted pair cables 16. Each of the audio monitors AM1 to AMn is assigned a discreet address and locational correspondence to one or more of the zoned alarm sensors S1 to Sn. That is, the audio monitors AM1 to AMn are digitally mapped at the audio controller 4 to the sensors S1 to Sn. More or less audio monitors may be provided than alarm sensors S1 to Sn. Typically, less audio monitors are required, since a single audio monitor can frequently monitor multiple closely spaced alarm sensors. For the presently preferred system, three audio monitors or microphone inputs M1, M2 and M3 are accommodated, reference FIGS. 2 and 3*a*, which monitor up to twelve mapped sensors S1 to Sn.

The audio controller 4 continuously monitors the audio data received from each monitor AM1 to AMn. During a pre-alarm state, when no alarm has been received from any of the alarm sensors S1 to Sn, the analog audio inputs from the conductors 16 are simultaneously threshold adjusted, summed, digitally encoded and coupled to a solid state audio storage memory, which comprises a static random access memory (RAM).

Figure 3G:
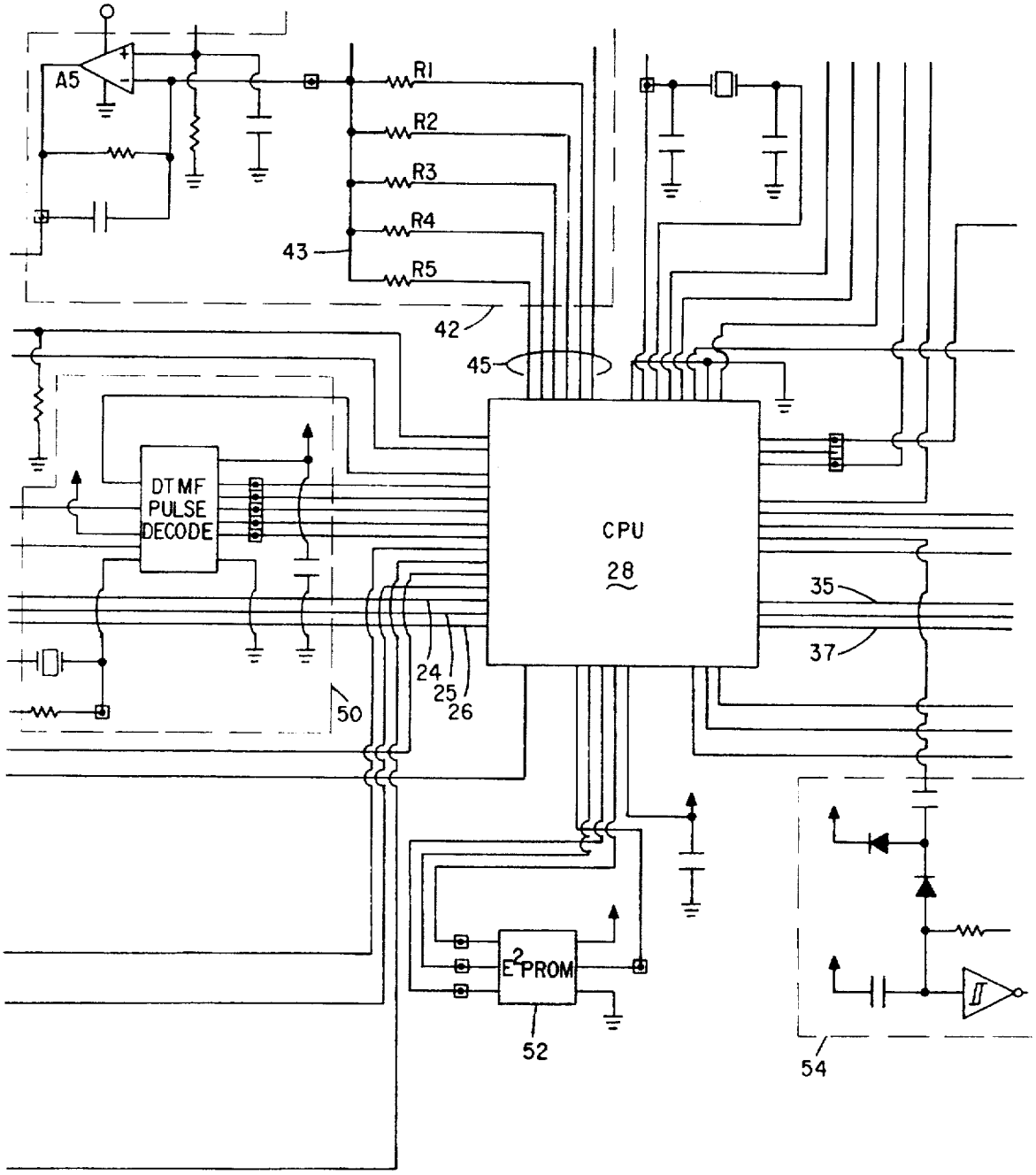
Figure 3H:
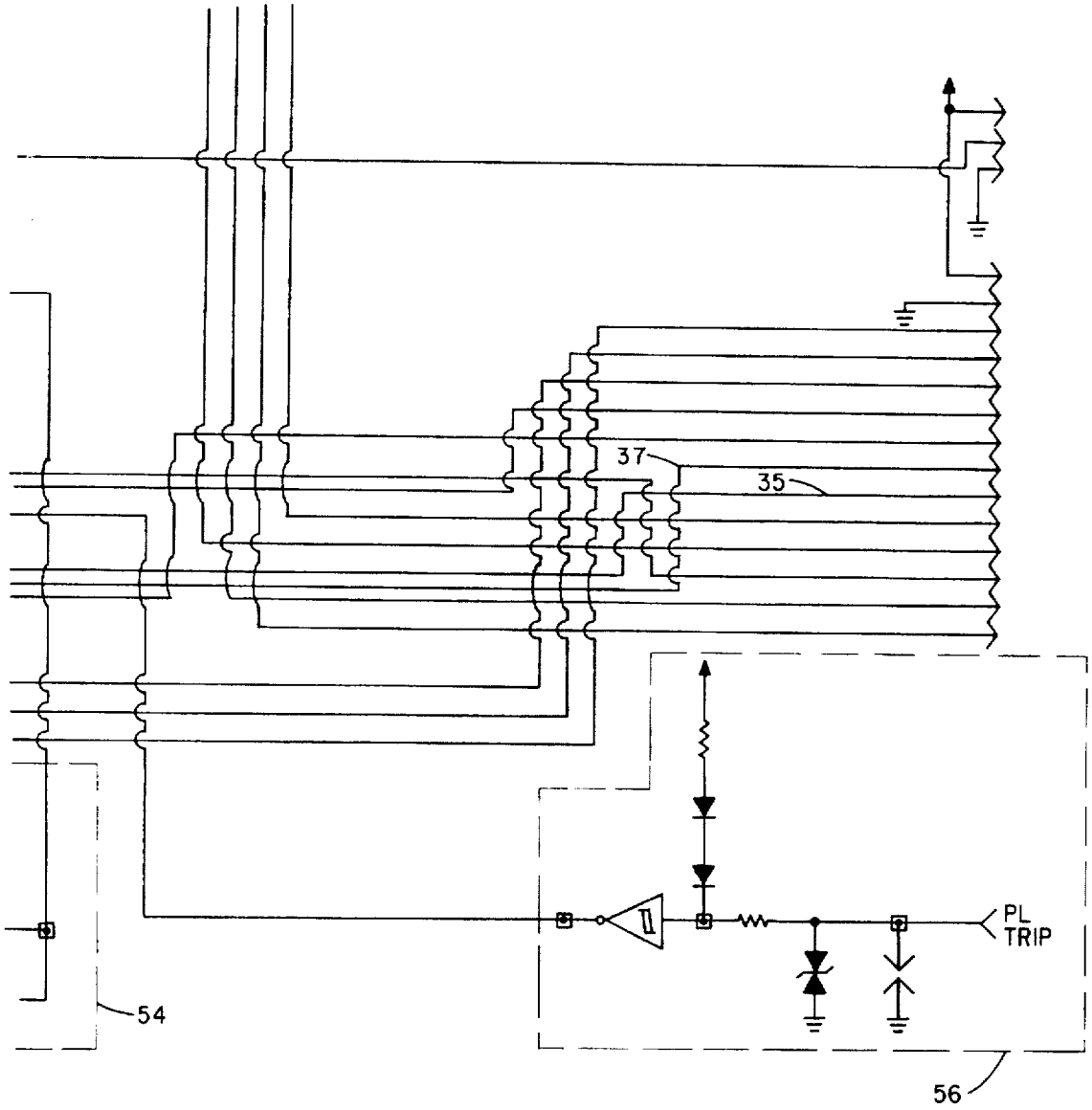
Figure 31:
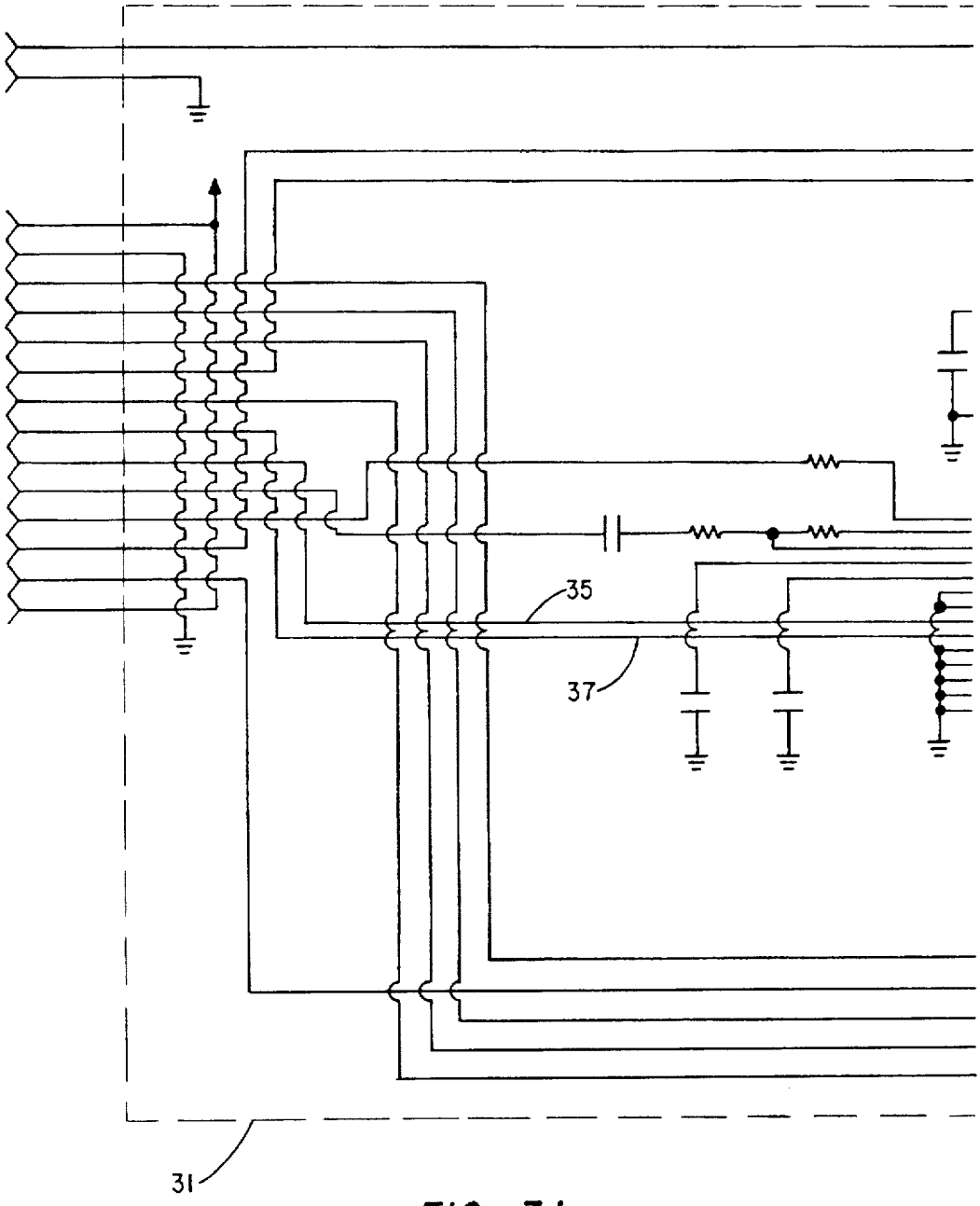
Figure 3J:
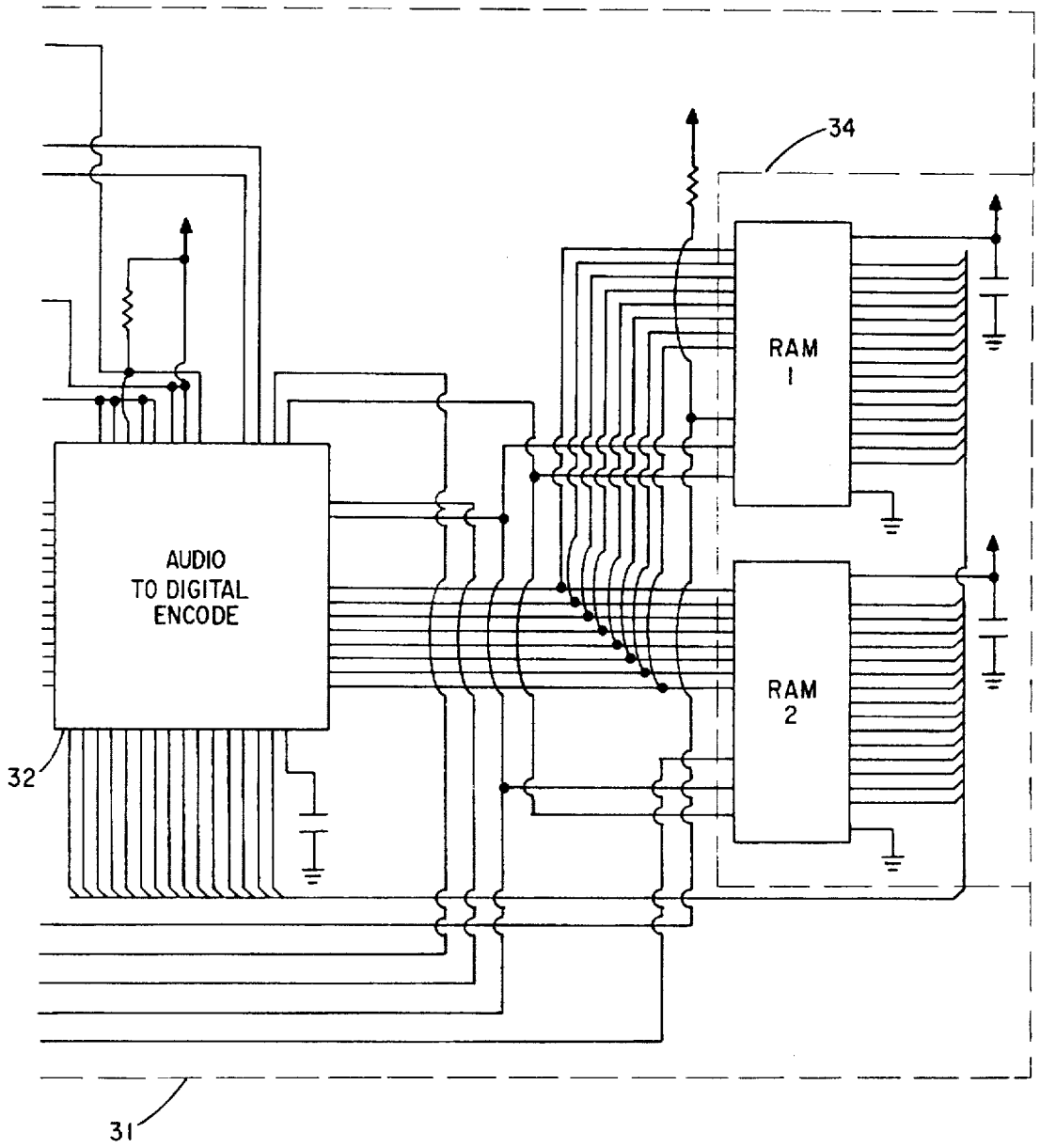

For the system 7, 16 seconds of audio data is always available in a 256 Kbit RAM storage memory contained in the audio record circuitry 31 at FIGS. 2 and 3*i*, 3*j*. Depending when an alarm condition is signaled by the system controller 64 to the audio controller 4, the audio controller 4 segments the stored data to provide from 4 to 8 seconds of pre-alarm data and 8 to 12 seconds of post-alarm data. More or less audio activity can be accommodated for different applications, provided an appropriately sized RAM memory is available.

During a pre-alarm condition, the analog data from each of the audio monitors AM1 to AMn is summed or compiled with the others before being stored into RAM. With the detection and reporting of an alarm state by one of the sensors S1 to Sn to the system controller SC1, the audio controller 4 automatically selects the audio monitor mapped to the sensor in alarm to record post event audio from only the sensor in alarm. The phone line between the audio controller 4 and system controller 6 is also seized and enabled by the audio controller to permit interactive communications between the secured premises and the central station 8. The sensed alarm, otherwise, is reported in conventional fashion by the system controller 6 to the central station 8.

Various actions can be taken by the central station 8 to interact with the audio controller 4 and the various audio monitors AM1 to AMn, depending when the operator at the central station responds in relation to the start of the alarm event. Most notably and within the first ten minutes following the detection of an alarm, central station operating personnel can override the automatic selection of the closest audio monitor and turn on all of the microphones AM1 to AMn or selectively enable each microphone to permit a real time, half-duplexed listening capability. The gain at each microphone may also be adjusted as desired by the operator.

The operator may also communicate with the alarm site via one or more speakers 38 distributed about the premises to challenge the individual who induced the alarm. Alternatively, the operator can replay the stored audio data at the time of the alarm, make certain subjective determinations, and take appropriate action, such as calling the police via the phone line PLP. The operator can also engage an auxiliary output coupled to an external device at the site such as a door latch or bell or extend the phone connection time.

Communications between the central station 8 and audio controller 4 are effected via the phone line PL1 upon seizure of the phone line. During an alarm condition and with the coupling of an active audio controller 4 to the central station 8, the operator is able to perform the above functions through entered DTMF commands at the central station 8. The DTMF signals are interpreted by a microprocessor or CPU 28 at the audio monitor 4 to selectively enable predefined responses, reference FIGS. 2 and 3*g*.

Figure 4A:
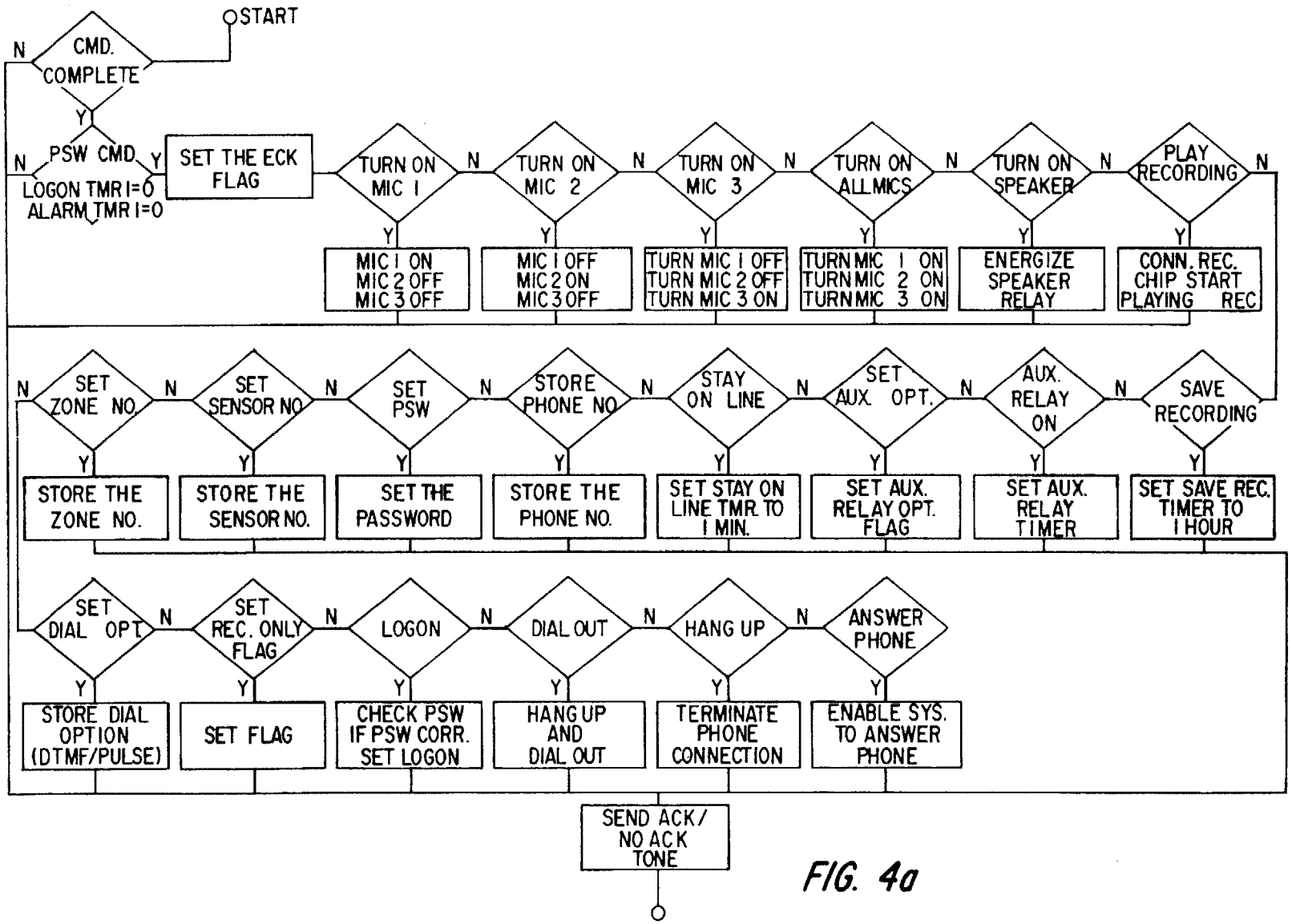
FIGS. 4*a*, 4*b*, 4*c*, and 4*d* show a generalized flow chart of the audio controller operation in relation to the microcoded instructions stored in appropriate memories coupled to a contained microprocessor.

In a non-alarm condition, the system installer or central station operator, through appropriately entered DTMF programming commands at a telephone handset coupled to line PL1, can program the audio controller 4 to 1) establish a password; 2) establish a dial type (DTMF/pulse) for the phone link; 3) set the phone number of the central station 8; 4) set identification parameters defining the audio monitor 4 to the central station 8; 5) set a record only flag, erase a prior recording; 6) turn a site speaker off; and 7) establish certain dial out options. The specific programming activities available to the operator are shown in Table 1 below which are entered between a DTMF header tone established for the asterisk key (*) at the central station phone handset or keyboard and a suffix tone established for the pound key (#) at the keyboard. FIG. 4*a* depicts a related flow chart of the various programming commands.

Programming is normally effected upon dialing the audio controller 4 and waiting 8 rings. The controller then responds with a pulsing high frequency tone. The * key is next depressed within 20 seconds of the tone and programming can be initiated, after entry of the "log on" command. Programming is disabled by pressing the "9" key.

Alternatively, to avoid an answering machine which may also be coupled to the phone line PL1 at the subscriber premises, the audio controller 4 is responsive to a call sequence. The currently defined sequence is performed by the installer/central station operator calling the controller 4; waiting through 3 rings; hanging up; and recalling after 10 seconds. The audio controller 4 then picks-up and acknowledges the call after the first ring.

TABLE 1

PROGRAM COMMANDS

| Command # | Command Action |
|---|---|
| 10 | Log On |
| 11 | Aux Output Manual Control |
| 12 | Retrieve Account Number |
| 30 | ALM Password |
| 31 | Dial Type |
| 32 | ALM Phone Number |
| 33 | Ring Detect Options |
| 34 | Unit Number |
| 35 | ITI Bus Zone |
| 36 | Delete an ITI Bus Zone |
| 37 | Record Only |
| 38 | Account Number |
| 39 | ALM Mode |
| 40 | Trip Level |
| 41 | Auxiliary Output Option |
| 42 | Auxiliary Output Pulse Time |
| 43 | House Code Settings |

NOTE: Commands 30 through 41 are used for programming, commands 10 and 12 are for administrative uses. The Log On procedure (command 10) must be performed before any other command can be performed.
NOTE: Command 11 will override the pulse time.

Table 2 discloses command actions which are enabled through activation of certain single tone or "hot key" commands which can be entered from the central station handset (not shown). These commands can only be entered within ten minutes of an alarm or upon entry of the programmed password, set via command 30 in Table I. Although a ten minute period immediately following the reporting of an alarm state is presently provided, it is to be appreciated the period be varied with appropriate modification to the CPU 28.

TABLE 2

HOT KEY COMMANDS

| Hot Key | Command Action |
|---|---|
| 0 | All Mikes ON |
| 1 | Only Mike 1 ON |
| 2 | Only Mike 2 ON |
| 3 | Only Mike 3 ON |
| 4 | Turn Speaker ON |
| 6 | Turn ON Aux Relay for 30 sec |
| 7 | Extend Connection Time |
| 8 | Dialback (at preset number) |
| 9 | Hang up |

Attention is next directed to a generalized block diagram of the audio controller 4 shown at FIG. 2 and wherefrom a more detailed description follows. As appropriate, further attention is directed to the detailed schematic diagrams of the audio controller circuitry depicted at FIGS. 3 and 3*a* through 3*j*. FIGS. 4*a* through 4*d* disclose flow diagrams of the detailed functions performed by the audio controller 4 in relation to the circuitry of FIGS. 3*a* through 3*j*. The various figures are cross referenced as appropriate.

The audio controller 4 electrically monitors a number of microphone inputs M1, M2 and M3 coupled to the audio controller 4. Presently, the audio controller 4 is able to monitor three inputs, either simultaneously or selectively. Each of the inputs M1, M2 and M3 are coupled to the controller 4 at microphone input/enable circuitry 20. The circuitry 20 threshold adjusts each received input before amplifying and filtering the received analog signals at microphone amp/filter select circuitry 22, reference FIG. 3*a*.

Each microphone input M1, M2 and M3 is particularly coupled via capacitors C9, C18 and C19 to one of three identical low pass filter stages, which are constructed from operational amplifiers A1, A2 and A3, reference FIG. 3*a*. Any transient signals are earlier suppressed and filtered via diodes D1, D2 and D3. Which of the three stages conducts depends upon the binary select signals at conductors 24, 25 and 26, which are provided from the central processing unit (CPU) 28. A Mitsubishi Corporation, Model M38002M4 microprocessor is presently used as the CPU 28 to control the operation of the audio controller 4, reference FIG. 3*g*. The select inputs appropriately bias the microphone inputs M1, M2 and M3 to either permit or prevent conduction. Prior to detecting an alarm, the CPU 28 normally allows each microphone M1, M2 and M3 to conduct. In this event, the outputs of each stage are summed or compiled together at junction "J1", reference FIG. 3*a*. Alternatively only a selected one of the microphones conducts, as determined by CPU 28.

The filtered and amplified audio output is coupled to manually controlled gain control circuitry 30, reference FIG. 3*b*. The gain control circuitry 30 is particularly adjusted to attenuate the audio output to prevent overdriving the following circuitry and most significantly the integrated audio record circuitry 31, reference FIGS. 3*i* and 3*j*.

The audio record circuitry 31 converts the analog audio signals to digital data and stores the data in an associated memory 34. Presently, an integrated voice response circuit 32, Oki Semiconductor Corporation part number MSM6309, is used to perform an analog to digital conversion of the audio signal. As the analog audio signal is received, it is digitally encoded and coupled to sequential addresses at an audio storage memory 34.

A pair of parallel coupled random access memories RAM 1 and RAM 2 form the audio storage memory 34. The memory 34 provides storage space for 2×256 Kbits of audio data and is segmented into eight 8 Kbyte segments. Each 8 Kbyte segment corresponds to approximately 2 seconds of audio activity. This arrangement permits the recording of 16 seconds of encoded audio data into eight, two second blocks. The organization also permits a continuous recording of the data without a loss of data, should an alarm occur during any one of the two second segments.

Depending when during any of the two second segments an alarm condition is signaled from the system controller 4, the CPU 28 produces a binary control signal on conductors 35 and 37 to the voice response circuit 31. This signal identifies the storage segment to which the succeeding encoded data is to be coupled. The CPU 28 with the selection of the next following two second segment, after the segment during which an alarm is detected, also automatically selects or enables the microphone input M1, M2, or M3 mapped to the location closest to the sensor S1 to Sn in alarm. At least four seconds of pre-alarm data are thus always contained in the memory 34.

During the remaining eight or twelve seconds, only the audio from the selected microphone input is gated into the audio memory 34. Thus, the audio memory 34 contains four to eight seconds of compiled audio from all microphone inputs M1, M2 and M3, prior to the detected alarm, and twelve or eight seconds of post-alarm audio from the microphone closest to the sensor in alarm. The data is available for playback by the central station 8 for a period, typically one hour, which is determined with the programming of the controller 4, reference FIG. 4*a*. Otherwise, the data is lost through normal memory operation and the timing out of the "save recording" timer implemented in software.

The principle operations performed by the audio controller 4 via the CPU 28 in responding to DTMF commands from the central station 8 are shown at FIG. 4*a*. Such commands are received during central station programming or during interactive communications during or following an alarm.

Figure 4B:
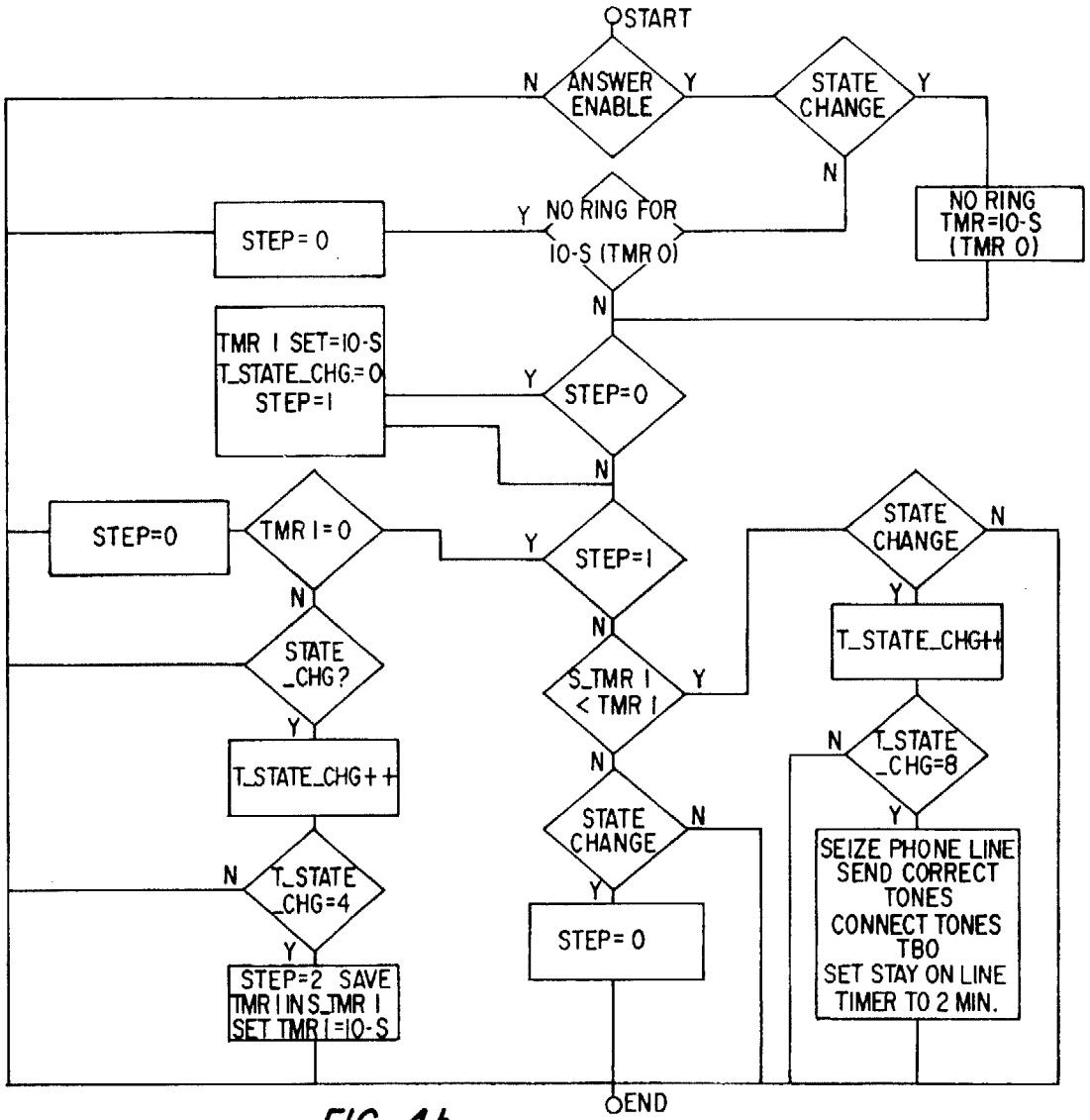
Figure 4C:
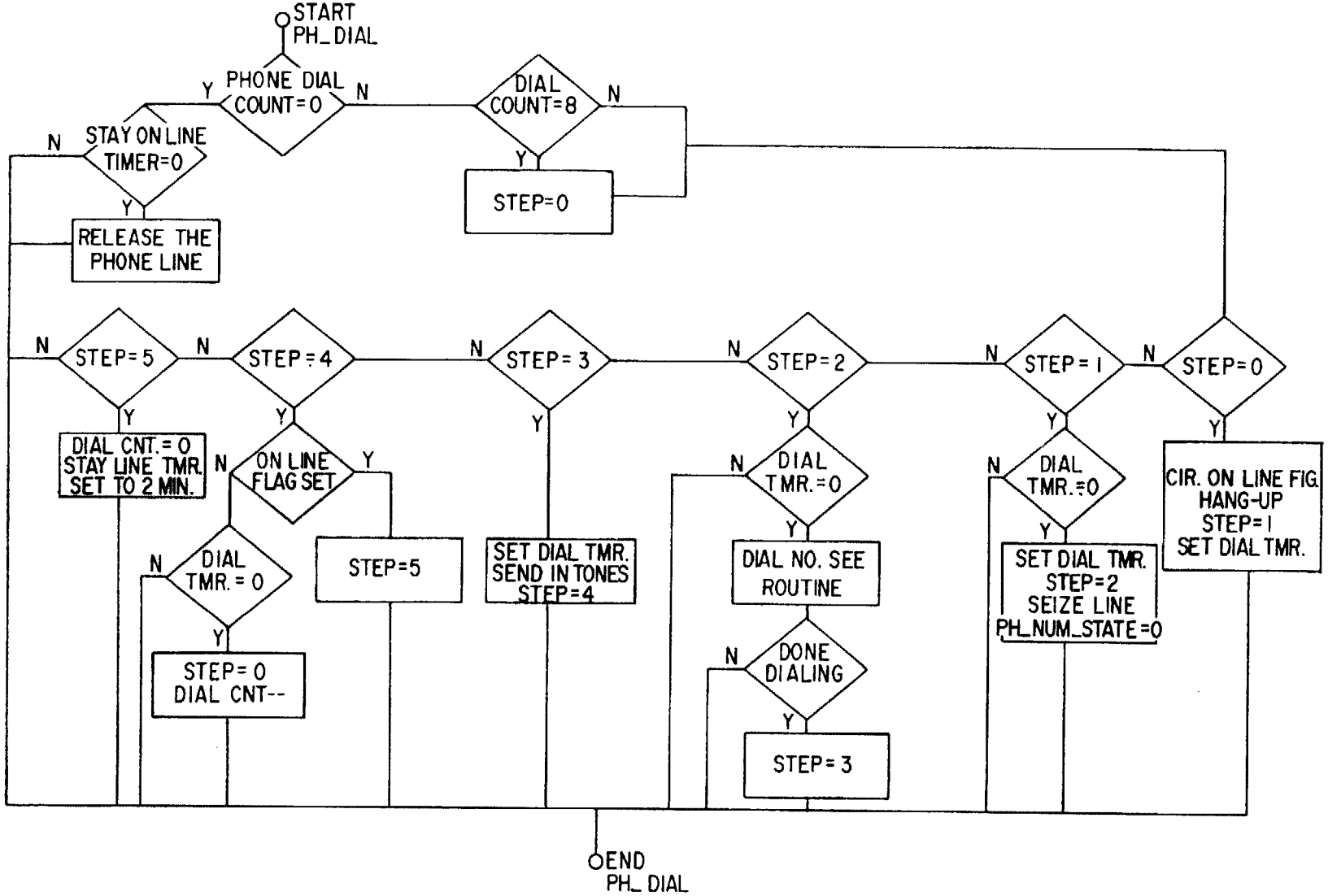

FIG. 4*b* depicts the principle operations performed by the audio controller 4 in relation to the monitoring of state changes at an alarm input from the system controller bus shown at FIG. 3*d*. FIG. 4*c* depicts the principle operations performed by the audio controller 4 in relation to controlling phone line seizure during transmissions from the controller 4 in the event of an alarm and responding to the availability of the phone line during programming transmissions from the central station 8. The availability of the phone line PL1 is also indicated at a PL trip input, reference FIG. 3*h*.

Figure 4D:
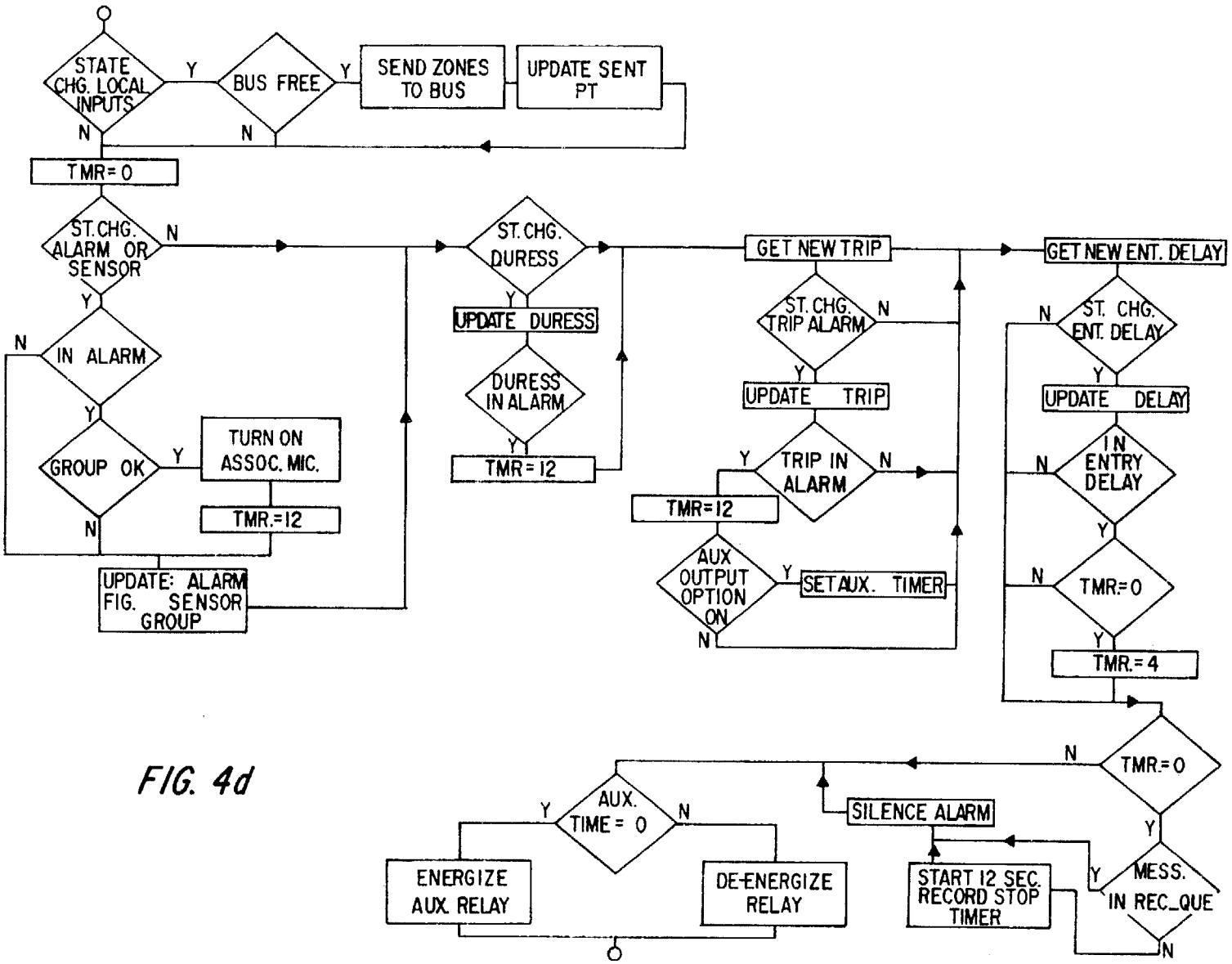

FIG. 4*d*, in turn, depicts the functions performed by the audio controller 4 in relation to the alarm state and type (i.e. normal or duress). Among these functions, the controller 4 controls the automatic selection of the microphone closest the sensor in alarm, the timed selection of an auxiliary relay, the playback of the storage memory 34, and the enabling of the speakers 38, sirens or other auxiliary devices coupled to output terminations at FIG. 3*h*.

When communications are initiated by the audio controller 4 in response to alarms detected by the system controller 6, the CPU 28 couples a signal on conductor 27 to a line seizure relay 29, reference FIG. 3*c*, which seizes the phone line PL1. Phone communications are then initiated with the coupling of appropriate binary signals from the CPU 28 to a six bit bus 45 and phone interface circuitry 48 via conductor 27 to initiate a call to the central station 8. The DTMF generation circuitry 42 produces the appropriate analog signals corresponding to the programmed central station phone number. The DTMF generation circuitry 42 is operative in relation to a previously programmed flag to produce either DTMF or pulse signals.

Most typically DTMF signals are produced, which are coupled to a low pass filter 40, which contains operational amplifier A6, reference FIG. 3*a*. From the filter 40, the signals are coupled to the phone line interface circuitry 48 and PL1. The specific functions performed are generally shown at the flow diagram of FIG. 4*c*.

The phone number of the central station 8 is contained in an electrically erasable, programmable memory ($E^2$PROM) 52, reference FIG. 3*g*. Also contained within the memory 52 are the other operating parameters programmed by the central station or installer into the controller 4, reference Table I and FIG. 4*a*. The stored microcode enables the further operation of the audio controller 4 per the flow diagrams of FIGS. 4*a* through 4*d* and as generally described herein.

The DTMF generation circuitry 42 generates DTMF and pulse signals via a resistance ladder 43, which includes resistors R0–R5 and an operational amplifier A5, reference FIG. 3*c*. Depending upon the stored microcode for the programmed phone number, appropriate voltages are generated by the circuitry 45 to effect conventional DTMF tones. Alternatively, pulse tones are generated, if the pulse option was previously selected.

The operations performed by the CPU 28 when answering incoming communications from the central station 8 are generally shown at the flow chart of FIG. 4*b*. During an answer condition and once a connection is established with the phone interface circuitry 48, the DTMF signals sent by the central station 8 are coupled to the decoding circuitry 50, reference FIG. 3*g*. The circuitry 50 appropriately converts the received DTMF signals to a binary form and couples the signals to the CPU 28 to establish interactive communications, once the proper logon command is received. Further communications proceed as set out in the programming operations of Table I or the alarm monitoring operations of Table II. During alarm monitoring, the central station 8 is able to communicate with the audio controller only in a half duplex fashion.

When responding to alarm monitor commands, a number of external input and output terminations are also provided at the audio controller 4. These terminations are encompassed within the external I/O circuitry 56 and speaker driver circuitry 39, reference FIGS. 3*d* and 3*h*.

With attention to the I/O circuitry 56, if Interactive Technologies Inc. is the manufacturer of the system controller 6 and audio controller 4, the two controllers can communicate per a common protocol via the "bus in" and "bus out" terminations. A phone line trip input from the system controller 6 indicates the availability of the phone line PL1. If the system controller is provided from another manufacturer, only the PL trip input is used and is referenced by the audio controller for the alarm condition of the system controller 6.

An auxiliary termination allows the central station operator to enable an auxiliary device such as a bell, door release or the like. Still another termination is provided to a wireless siren. Alternatively, the siren termination or other terminations can be provided to so called X10 transformers which can be coupled via the power conductors at the monitored premises to sundry other appliances, such as lights, stereos, etc.

An output is also provided from the CPU 28 via a conductor 59 to a relay 57 which is coupled to the speakers 38.

With the entry of the appropriate commands of Table II by central station personnel, the external I/O circuitry 56 particularly permits the enabling of one or more of the broadcast speakers 38. The central station operator is thereby able to converse with the secured premises and challenge an intruder. Alternatively, a local siren or other device coupled to the auxiliary output can be activated.

A so-called "watchdog timer" circuit 54 is also coupled to the CPU 28, FIG. 3*b*. The timer 54 monitors the cyclical operation of the CPU 28 and is periodically reset with the completion of each loop. Typically, the timer 54 is reset before it times out. However, if the CPU 28 locks into an indefinite loop or otherwise loses track of where it is in its operation, the timer 54, times out and resets the CPU 28.

Lastly, regulated power is supplied to the audio controller 4 via voltage regulation circuitry 58, reference FIGS. 3*a* and 3*b*. The circuitry 58 particularly provides a 5 volt D.C. voltage V1 which is appropriately coupled to the audio controller circuitry of FIGS. 3*a* through 3*j*.

While the invention has been described with respect to its presently preferred construction, it is to be appreciated various alternative constructions might be suggested to those skilled in the art. The following claims should therefore be interpreted to include all those equivalent embodiments within the spirit and scope thereof.

What is claimed is:

1. Security alarm apparatus including a central station which communicates via a telephone link to a subscriber system controller, said system controller being responsive to a plurality of alarm sensors distributed about a subscriber premises, and further including;

a) a plurality of audio means for detecting audible sounds, wherein each of said audio means is located in audible proximity to at least one of said plurality of alarm sensors; and b) audio controller means coupled to each of said plurality of audio means and to said central station and responsive to alarm conditions detected by said system controller from said plurality of alarm sensors for continuously monitoring the audio input of each of said audio means and prior to the detection of an alarm condition storing periodic compilations of the audio input of all of said plurality of audio means to a single address of a storage means, and after detecting an alarm condition for automatically selecting and storing the audio input from only the audio means in closest physical proximity to an alarm sensor reporting the alarm condition at a second address of said storage means, and including means for seizing said telephone link and establishing communications from said central station to the audio means in closest physical proximity to the alarm sensor reporting an alarm condition with the reporting of the alarm condition, whereby a record of pre and post audio activity is available to the central station monitoring personnel and who may also directly listen and converse with the alarm site.

2. Apparatus as set forth in claim 1 wherein said audio controller means includes means for accessing said telephone link and establishing voice communications between said central station and the subscriber premises.

3. Apparatus as set forth in claim 2 including a plurality of speakers which are distributed about the subscriber premises and wherein said audio controller means includes means for selectively enabling said voice communications through a selected one or more of said speakers.

4. Apparatus as set forth in claim 3 including filter means for preventing the recording of central station voice communications to the subscriber premises after an alarm from the stored audio data.

5. Apparatus as set forth in claim 3 wherein said audio controller means further includes means for preventing central station listening and communications to the subscriber premises after a predetermined period of time immediately following the reporting of one of said alarm conditions to the central station unless a programmed password is entered, thereby preventing non-emergency eavesdropping by the central station.

6. Apparatus as set forth in claim 3 including at least one annunciator means at the subscriber premises and wherein said audio controller means includes means for selectively enabling said annunciator means.

7. Apparatus as set forth in claim 1 including means for digitally encoding said first and second periods of audio inputs and for storing the first and second periods in random access memory means organized into a plurality of incremental storage periods and such that greater than fifty percent of stored data comprises the data of said second period.

8. In a security alarm system including a central station which communicates with a subscriber premises, apparatus comprising:

a) a plurality of audio means for detecting analog audible sounds, wherein each of said audio means is mounted in audible proximity to at least one of a plurality of alarm sensors; and b) audio controller means coupled to each of said audio means and separately coupled to said central station via a telephone line, comprising;

i) receiver means for receiving an audio input from each of the plurality of audio means, ii) means for digitally encoding the analog audio inputs of each of said audio means into audio data, iii) means for storing the audio data in random access memory means, iv) means coupled to the telephone line for encoding and decoding DTMF signals, and v) processor means responsive to detected alarm conditions for coupling all of said audio means to said digital encoding mans, prior to an alarm condition, and only the audio means in closest physical proximity to an alarm sensor reporting an alarm, after the reporting of an alarm, for periodically compiling the pre alarm audio data from all of the audio means and storing the data to a first address of said random access memory, for storing post alarm audio data from the single audio means to a second address, after detecting an alarm, for seizing said telephone line and establishing communications from said central station to the audio means in closest physical proximity to the alarm sensor reporting an alarm condition with the reporting of the alarm condition, and thereafter for selectively 1) coupling voice communications from the central station to the subscriber premises through a speaker and 2) listening to the audio means.

9. Apparatus as set forth in claim 8 including means for preventing central station listening to the subscriber premises after a predetermined period immediately succeeding the detection of an alarm condition unless a programmed password is entered, thereby preventing non-emergency eavesdropping by the central station.

10. In a security alarm system including a central station which communicates with a subscriber premises via a telephone link, apparatus comprising:

a) a system controller coupled to a plurality of alarm sensors distributed about a subscriber premises;

b) a plurality of microphones, wherein each of said microphones is mounted in audible proximity to at least one of said plurality of alarm sensors; and c) audio controller means coupled via a phone line to said central station for continuously monitoring each of said microphones and for periodically storing digital data compilations of the audio inputs from each of said microphones at a first address of a memory means, prior to an alarm, and for selecting and storing audio data from the microphone in closest proximity to an active alarm sensor at a second address for a predetermined period of time after the detection of an alarm, until reset, and including means for seizing said telephone link and establishing communications from said central station to the audio means in closest physical proximity to the alarm sensor reporting an alarm condition with the reporting of the alarm condition.

11. Apparatus as set forth in claim 10 wherein said audio controller means further includes filter means for preventing the storing of central station voice communications to the subscriber premises after an alarm from the stored audio data and means for preventing central station listening and communications after a predetermined period of time immediately following the reporting of an alarm unless a programmed password is entered, thereby preventing non-emergency eavesdropping by the central station.

* * * * *